US005382295A

United States Patent [19]

Aoki et al.

[11] Patent Number: 5,382,295

[45] Date of Patent: Jan. 17, 1995

[54] METHOD FOR CLEANING ALUMINUM AND ALUMINUM ALLOYS

[75] Inventors: Tomoyuki Aoki, Chigasaki; Yoji Ono, Hiratsuka, both of Japan

[73] Assignee: Henkel Corporation, Plymouth Meeting, Pa.

[21] Appl. No.: 64,082

[22] PCT Filed: Nov. 12, 1991

[86] PCT No.: PCT/US91/08250

§ 371 Date: May 20, 1993

§ 102(e) Date: May 20, 1993

[30] Foreign Application Priority Data

Nov. 20, 1990 [JP] Japan ..... 2-314876

[51] Int. Cl.[6] ..... C11D 7/06; C23G 1/14

[52] U.S. Cl. ..... 134/2; 134/3; 134/42; 252/156; 252/174.14; 252/174.16

[58] Field of Search ..... 134/2, 29, 41, 3; 252/135, 156, 174.14, 174.16, 174.19, 526, 545

[56] References Cited

U.S. PATENT DOCUMENTS 3,687,858 8/1972 Geisler et al. ..... 252/156
4,126,483 11/1978 Donakowski et al. ..... 134/29 X
4,382,825 5/1983 McCready ..... 134/2
4,528,039 7/1985 Rubin et al. ..... 252/174.14 X
4,540,444 9/1985 Kelly ..... 134/29 X
4,762,638 8/1988 Dollman et al. ..... 252/156 X
4,778,533 12/1988 Gregory et al. ..... 134/29

FOREIGN PATENT DOCUMENTS 0201864 5/1986 European Pat. Off. .

*Primary Examiner*—Richard O. Dean
*Assistant Examiner*—Saeed T. Chaudhry
*Attorney, Agent, or Firm*—Ernest G. Szoke; Wayne C. Jaeschke; Norvell E. Wisdom, Jr.

[57] ABSTRACT

An aqueous alkaline cleaner for aluminum has a pH in the range from 10.0–12.0 and contains:

(A) from 0.5 to 10.0 g/L of an alkali builder component;

(B) from 0.5 to 10.0 g/L of aminoalkyl- and/or hydroxyalkyldi-phosphonic acids and/or their water soluble salts;

(C) from 0.1 to 3.0 g/L of an aluminum ion sequestering agent component; and (D) from 0.5 to 5.0 g/L of a surfactant component.

Cleaning aluminum and aluminum alloy with such a cleaner generates an excellent surface condition with respect to de-smutting performance, water wettability, avoidance of black smut production, blackening, and paint adherence at least as good as that achieved with conventional acid cleaners, without requiring any acid wash.

20 Claims, No Drawings

METHOD FOR CLEANING ALUMINUM AND ALUMINUM ALLOYS

TECHNICAL FIELD

The present invention relates to a novel method for cleaning aluminum and aluminum alloys (both being denoted briefly below, unless the context requires otherwise, by the simple term "aluminum") which generates a surface condition that is optimal for subsequent conversion treatments and that strongly resists the development of black smut on the aluminum surface. The invention may be employed to clean the surface of aluminum sheet, strip, container, or the like.

BACKGROUND ART

Aluminum containers are typically manufactured by a drawing and forming operation known as draw-ironing or drawing and ironing. This process results in the deposition of lubricant and forming oil on the container surface. In addition, small fragments of leftover aluminum are often deposited on the surface and are present in relatively large quantities on the interior surface of the container. The container surface is cleaned prior to, for example, conversion treatment or painting of the container, and the surface must be free of contaminants which would result in less than an excellent water wettability and thus impair subsequent container processing.

At present, the compositions normally employed commercially to clean aluminum containers are aqueous sulfuric acid solutions containing hydrofluoric acid and at least one surfactant or aqueous solutions containing phosphoric acid, nitric acid, or $Fe^{3+}$, and sulfuric acid and at least one surfactant. These cleaning solutions are extremely effective and offer many advantages, but they nevertheless suffer from certain types of problems inherent to such acidic cleaning compositions. Thus, for example, these compositions can dissolve and corrode the stainless steel equipment or other ferrous alloy equipment which is typically used for a container cleaning line. Moreover, discharge of any hydrofluoric acid and fluoride present in the rinse water and spent cleaning bath causes environmental problems. In the case of $Fe^{3+}$-containing cleaning solutions, the iron hydroxide present in the preliminary hot water rinse prior to the cleaning step may stick in the heat exchanger.

Alkaline cleaning solutions have already been formulated in an attempt to solve these problems; however, known alkaline cleaning solutions are themselves associated with problems which impair their commercial application. For example, when the use of an alkali metal hydroxide containing cleaning solution is attempted, an irregular etch is often obtained with broad range of aluminum containers. Also, when the line is interrupted due to operational problems downstream from the container cleaning line while the spray alone continues to operate, black smut is produced from aluminum alloy components due to excessive etching. Such containers are commercially useless. In addition, the hydroxide layer continues to grow on the surface of the aluminum after an alkaline cleaning and becomes substantially thicker than the hydroxide layer after an acidic cleaning. A thick hydroxide layer creates problems in any subsequent conversion treatment and accordingly results in a poor corrosion resistance. Finally, magnesium is segregated to the aluminum surface after an alkaline cleaning of alloys that include magnesium, and this causes, inter alia, an unsatisfactory paint adherence.

Thus, in order to remove this hydroxide layer and segregated Mg, it becomes necessary to implement an acidic wash, for example by nitric acid, after an alkaline cleaning. However, plant space and available equipment considerations make it difficult to introduce an acid wash step into the container cleaning line. In sum, prior alkaline cleaning solutions exhibit various problems as detailed above.

DESCRIPTION OF THE INVENTION

Problem to Be Solved by the Invention

The present invention has as its major object the introduction of a method for cleaning aluminum and aluminum alloy which exhibits a uniform etching performance that is not subject to large changes in rate with continued use, provides excellent de-smutting, and, without using an acid wash, nevertheless suppresses hydroxide layer growth and eliminates surface segregated magnesium.

SUMMARY OF THE INVENTION

As a concrete means for solving the problems associated with the prior art as discussed above, the present invention comprises a method for cleaning aluminum and aluminum alloys wherein said method is characterized by contacting the surface of aluminum, preferably by spray or immersion for from 20 to 60 seconds, with an aqueous alkaline cleaning composition, preferably at a temperature in the range from 50° to 70° C., which has a pH of 10.0 to 12.0 and which comprises, preferably consists essentially of, or more preferably consists of, water and:

(A) from 0.5 to 10.0 grams per liter (hereinafter "g/L") of at least one alkali builder selected from the group consisting of alkali metal hydroxides, inorganic alkali metal phosphates, and/or alkali metal carbonates;

(B) from 0.5 to 10.0 g/L of at least one compound selected from the aminoalkylphosphonic acids and hydroxyalkyldiphosphonic acids and/or their water soluble salts;

(C) from 0.1 to 3.0 g/L of at least one aluminum ion sequestering agent selected from the alkali metal gluconates, alkali metal heptogluconates, alkali metal oxalates, alkali metal tartrates, and/or sorbitol; and (D) from 0.5 to 5.0 g/L of a surfactant component.

This cleaning method not only evidences a highly uniform etching rate and effect on the aluminum surface, but also a very robust (=durable) etching performance and excellent de-smutting performance. Moreover, growth of the hydroxide layer is prevented and the surface segregated Mg is eliminated. It therefore solves the numerous problems associated with the prior art examples.

DETAILS OF PREFERRED EMBODIMENTS OF THE INVENTION

The alkali metal salt comprising the alkali builder preferably consists of one or more selections from the potassium and sodium hydroxides, carbonates, and inorganic phosphates, and examples in this regard are sodium hydroxide, sodium carbonate, trisodium phosphate, and potassium hydroxide. The quantity required for etching is 0.5 to 10.0 g/L and preferably 1.0 to 5.0 g/L. At less than 0.5 g/L, etching becomes unsatisfactory and the aluminum surface becomes nonuniform.

No additional effect in terms of etching capacity is observed for values in excess of 10.0 g/L, while the aluminum surface is roughened by excessive etching.

The aminoalkylphosphonic acid is exemplified by aminotrimethylenephosphonic acid, which has the chemical formula:

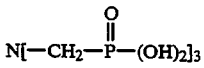

(1)

and by ethylenediaminetetramethylenephosphonic acid, which has the chemical formula:

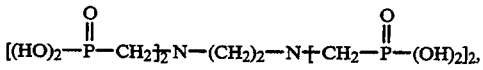

(2)

and the hydroxyalkyldiphosphonic acid is exemplified by 1-hydroxyethylidene-1,1-diphosphonic acid, which has the chemical formula:

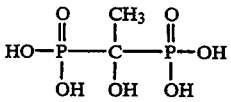

(3)

The total concentration of phosphonic acids and/or their salts should preferably be in the range from 0.5 to 10.0 g/L and more preferably is in the range from 2.0 to 7.0 g/L. Satisfactory inhibition of black smut production will not usually be achieved with less than 0.5 g/L. No additional significant technical benefit is observed for quantities in excess of 10.0 g/L, and higher concentrations normally should be avoided due to the high costs involved.

No particular restriction is placed on the surfactant in terms of whether it is a cationic surfactant, anionic surfactant, nonionic surfactant, or a mixture of two or more of these types. Nonionic surfactants are exemplified by hydrocarbon derivatives, abietic acid derivatives, ethoxylated primary alcohols, and modified polyethoxylated alcohols. In any case, at least one surfactant selection must be present, and the total concentration of surfactants should be 0.5 to 5.0 g/L and preferably 0.5 to 2.5 g/L.

The aluminum sequestering agent may be alkali metal gluconates, alkali metal heptogluconates, alkali metal oxalates, alkali metal tartrates, and/or sorbitol. At least one compound is selected therefrom without restriction and is added to the cleaning bath to serve as an aluminum sequestering agent. The aluminum sequestering agent should be present at a concentration of from 0.1 to 3.0 g/L. At concentrations less than 0.1 g/L, bonding with aluminum ion eluting from the aluminum surface during its cleaning will be weak and the sequestering effect will therefore be weak. The etching performance and smut removal are then readily impaired by the aluminum ion accumulating in the cleaning bath. In contrast to this, the sequestering activity is saturated at concentrations greater than 3.0 g/L and an increase in effect cannot be expected.

The pH of the cleaning bath should be in the range from 10.0 to 12.0. At values less than 10.0, the aluminum surface will usually be nonuniform due to an inadequate etch, and the smut adhering to the aluminum cannot be removed to a satisfactory degree. At pH values in excess of 12.0, the corrosion resistance (blackening) after conversion treatment will be reduced due to the production of trace amounts of black smut as a result of an excessive etch.

The benefits from the present invention will be explained more concretely below through several illustrative and comparison examples.

EXAMPLES 1 -7

(1) Cleaning Bath Compositions

The composition of the cleaning bath for each example is reported in Table 1, where the surfactants used are identified by numbers with the following meaning (EO=ethylene oxide; PO=propylene oxide):

surfactant (1): {nonylphenol+11 moles EO} adduct (hydrocarbon derivative type)

surfactant (2): {higher alcohol+5 moles EO+10 moles PO} adduct (hydrocarbon derivative type)

surfactant (3): {nonylphenol+18 moles EO} adduct (hydrocarbon derivative type)

surfactant (4): {higher alcohol+5 moles EO+15 moles PO} adduct (hydrocarbon derivative type)

(2) Test Material

Uncleaned drawn and ironed cylindrical containers 66 millimeters (hereinafter "mm") in diameter×124 mm high, made from type A3004 aluminum alloy sheet.

(3) Test Conditions

The bath temperature, treatment method, and treatment time are reported in Table 2 for each example. Cleaning of each sample container was conducted according to one of the following process sequences (1) and (2) in the examples, depending on the test to be performed as specified below.

Process Sequence (1):

1. cleaning
2. tap water rinse (10 seconds, spray)
3. rinse with deionized water (10 seconds, spray)
4. drying (hot air, 180° C.)

Process Sequence (2):

1. cleaning
2. water rinse (10 seconds, spray)
3. conversion treatment as follows:

agent: ALODINE TM 404 from Nihon Parkerizing Co., Ltd.

TABLE 1

| | Composition of cleaning baths for aluminum and aluminum alloy | | | | |
|---|---|---|---|---|---|
| number | alkali metal salt | organophosphonic acid | Al sequestering agent | surfactant (alkaline cleaning solution) | bath pH |
| Examples | | | | | |
| 1 | NaOH 1.7 g/L | ethylenediaminetetramethylene-phosphonic acid, 2.0 g/L | Na heptoglu-conate, 1.0 g/L | 1: 1.0 g/L 2: 1.0 g/L | 11.0 |
| 2 | NaOH 1.7 g/L | 1-hydroxyethylidene-1,1-diphosphonic acid, 2.0 g/L | Na gluconate, 2.0 g/L | 3: 1.0 g/L 4: 1.0 g/L | 11.5 |
| 3 | $Na_3PO_4$ | ethylenediaminetetramethylene- | Na gluconate, | 1: 1.5 g/L | 10.5 |

TABLE 1-continued

| number | alkali metal salt | organophosphonic acid | Al sequestering agent | surfactant (alkaline cleaning solution) | bath pH |
|---|---|---|---|---|---|
| | Composition of cleaning baths for aluminum and aluminum alloy | | | | |
| | 5.0 g/L | phosphonic acid, 1.3 g/L | 1.0 g/L | 2: 0.5 g/L | |
| 4 | KOH 5.0 g/L | ethylenediaminetetramethylene-phosphonic acid, 7.6 g/L | Na heptoglu-conate, 2.0 g/L | 3: 0.3 g/L 4: 0.5 g/L | 10.0 |
| 5 | $Na_2CO_3$ 10 g/L | aminotrimethylenephosphonic acid, 2.0 g/L | Na heptoglu-conate, 3.0 g/L | 1: 2.0 g/L 4: 2.5 g/L | 10.5 |
| 6 | NaOH 5.0 g/L | ethylenediaminetetramethylene-phosphonic acid, 7.6 g/L | Na heptoglu-conate, 0.3 g/L | 2: 0.5 g/L 3: 1.5 g/L | 11.0 |
| 7 | NaOH 0.7 g/L | 1-hydroxyethylidene-1,1-diphosphonic acid, 0.7 g/L | potassium oxalate, 1.0 g/L | 1: 2.0 g/L | 10.5 |
| Comparison Examples | | | | | |
| 1 | NaOH 1.7 g/L | — | — | 1: 2.0 g/L | 12.0 |
| 2 | NaOH 5.0 g/L | ethylenediaminetetramethylene-phosphonic acid, 0.05 g/L | — | 1: 1.0 g/L 2: 1.0 g/L | 12.4 |
| 3 | $Na_3PO_4$ 3.0 g/L | — | Na heptoglu-conate, 1.0 g/L | 3: 1.0 g/L 4: 1.0 g/L | 11.3 |
| 4 | KOH 0.05 g/L | 1-hydroxyethylidene-1,1-diphosphonic acid, 2.0 g/L | Na tartrate, 1.0 g/L | 3: 1.5 g/L 4: 0.5 g/L | 2.4 |
| 5 | NaOH 1.7 g/L sodium heptogluconate 1.0 g/L | | 5% nitric acid | 1: 1.0 g/L 2: 1.0 g/L | — |

TABLE 2

| number | treatment conditions: bath temperature °C. | method | time (seconds)* |
|---|---|---|---|
| Examples | | | |
| 1 | 60 | spray | 50 |
| 2 | 60 | spray | 50 |
| 3 | 60 | spray | 50 |
| 4 | 60 | spray | 30 |
| 5 | 60 | spray | 20 |
| 6 | 50 | spray | 50 |
| 7 | 70 | immersion | 60 |
| Comparison Examples | | | |
| 1 | 60 | spray | 50 |
| 2 | 70 | spray | 50 |
| 3 | 60 | spray | 50 |
| 4 | 60 | spray | 50 |
| 5 | | | |

| number | results: de-smut-ting | water wet-tability | black smut production | blacken-ing | paint ad-herence |
|---|---|---|---|---|---|
| Examples | | | | | |
| 1 | 5 | 100 | 10 | 10 | 10 |
| 2 | 5 | 100 | 10 | 9 | 10 |
| 3 | 5 | 100 | 10 | 10 | 10 |
| 4 | 5 | 100 | 10 | 10 | 10 |
| 5 | 5 | 100 | 10 | 9 | 10 |
| 6 | 5 | 100 | 10 | 10 | 10 |
| 7 | 5 | 100 | 10 | 9 | 9 |
| Comparison Examples | | | | | |
| 1 | 5 | 100 | 1 | 1 | 3 |
| 2 | 5 | 100 | 5 | 5 | 6 |
| 3 | 5 | 100 | 1 | 1 | 5 |
| 4 | 2 | 100 | 8 | 7 | 4 |
| 5 | 5 | 100 | 10 | 10 | 10 |

*This time was always 10 minutes in the evaluation of black smut production in the Examples and Comparison Examples.

concentration: 2%
temperature: 32° C.
pH: 3.0
time: 30 seconds
method: spray
4. tap water rinse ( 10 seconds, spray)
5. rinse with de-ionized water ( 10 seconds, spray)
6. drying (hot air, 180° C.)

(4) Property Testing and Evaluation

De-smutting:

After the drying step 4 in process sequence (1), the same cellophane tape was applied and peeled off at three locations on the interior wall of the container, and the smut adhering on the tape was visually evaluated and scored on a 5-point scale:

5 = no adhering smut (excellent)

↓

1 = overall presence of adhering smut (poor).

Water wettability:

After the water rinse step 2 in process sequence (1), the container was allowed to stand for 30 seconds and the water-wetted area was then evaluated in %.

Black smut:

The cleaning step 1 in process sequence (1) was carried out for 10 minutes. After the drying step 4. in process sequence (1), the adherence of black smut product on the container was visually evaluated and rated on the following scale.

10 = no black smut (excellent)

↓

1 = production of black smut over entire surface (poor)

Blackening:

After the drying step 6 in process sequence (2), the bottom of the container was immersed for 30 minutes in boiling tap water, and the degree of blackening was then visually evaluated and reported on the following scale.

10 = no blackening (excellent)

↓

1 = dark black color (poor)

Paint adherence:

After the drying step 6 in process sequence (2), an epoxy-urea paint system (film thickness=5 micrometers) was applied to the container, followed by baking for 3 minutes at 215° C. A grid pattern was then cut into the interior surface of the container and the container was subsequently immersed for 60 minutes in boiling test solution (test solution=sodium chloride 5 g/L and citric acid 5 g/L, in de-ionized water). This was followed by a water rinse, spontaneous drying, and peeling with tape, and the degree of peeling was visually evaluated and reported on the following scale.

10 = no peeling (excellent)

↓

1 = peeling over entire surface of test region (poor)

COMPARISON EXAMPLES 1 TO 4

As for the Examples, the composition of the cleaning bath is reported in Table 1, and the bath temperature, treatment method, and time are reported in Table 2. The test material was the same as in the Examples. The treatment processes and property testing and evaluation were also the same as in the Examples.

COMPARISON EXAMPLE 5

The cleaning bath composition used in this Comparison Example 5 is reported in Table 1, and the test material was the same as in the Examples. However, in contrast to the Examples and Comparison Examples 1–3, an acid cleaning was used for this example. The cleaning process sequence (3) was as shown below. The water wettability was tested immediately after water rinse step 4 in the following sequence, and the black smut production and desmutting were evaluated on samples that were removed from the process sequence after step 4 and then dried. Blackening and adherence were evaluated after step 8 in process sequence (3).

Process Sequence (3)

1. cleaning (60° C., spray, 50 seconds)
2. water rinse (10 seconds, spray)
3. acid rinse (40° C., spray, 30 seconds)
4. tap water rinse (10 seconds, spray)
5. conversion treatment (as in the Examples)
6. tap water rinse (10 seconds, spray)
7. de-ionized water rinse (10 seconds, spray)
8. drying (180° C., hot air)

Benefits of the Invention

The method of the present invention for cleaning aluminum and aluminum alloy generates an excellent surface condition in all respects tested (de-smutting performance, water wettability, black smut production, blackening, paint adherence) without requiring any acid wash.

The invention claimed is:

1. A method for cleaning aluminum by contacting the surface of the aluminum with an aqueous alkaline cleaning composition that has a pH of 10.0 to 12.0 and consists essentially of water and:

(A) from 0.5 to 10.0 g/L of an alkali builder component selected from the group consisting of alkali metal hydroxides, inorganic alkali metal phosphates, alkali metal carbonates, and mixtures thereof;

(B) from 0.5 to 10.0 g/L of a component selected from the group consisting of aminoalkylphosphonic acids, hydroxyalkyldiphosphonic acids, water soluble salts thereof, and mixtures of any two or more of these;

(C) from 0.1 to 3.0 g/L of an aluminum ion sequestering agent component selected from the group consisting of alkali metal gluconates, alkali metal heptogluconates, alkali metal oxalates, alkali metal tartrates, sorbitol, and mixtures thereof; and (D) from 0.5 to 5.0 g/L of a surfactant component.

2. A method according to claim 1, wherein the concentration of component (A) is in the range from 1.0–5.0 g/L.

3. A method according to claim 2, wherein the concentration of component (B) is in the range from 2.0 to 7.0 g/L.

4. A method according to claim 3, wherein the concentration of component (D) is in the range from 0.5–2.5 g/L.

5. A method according to claim 4, wherein the aqueous alkaline cleaning composition is contacted with the aluminum surface to be cleaned at a temperature in the range from 50°–70° C. by spray or immersion for a time of from 20 to 60 seconds.

6. A method according to claim 5, wherein component (B) consists of ethylenediaminetetramethylenephosphonic acid, one of its water soluble salts, or mixtures thereof.

7. A method according to claim 5, wherein component (B) consists of 1-hydroxyethylidene-1,1-diphosphonic acid, one of its water soluble salts, or mixtures thereof.

8. A method according to claim 5 wherein component (B) consists of aminotrimethylenephosphonic acid, one of its water soluble salts, or mixtures thereof.

9. A method according to claim 2, wherein the concentration of component (D) is in the range from 0.5–2.5 g/L.

10. A method according to claim 9, wherein the aqueous alkaline cleaning composition is contacted with the aluminum surface to be cleaned at a temperature in the range from 50°–70° C. by spray or immersion for a time of from 20 to 60 seconds.

11. A method according to claim 10, wherein component (B) consists of ethylenediaminetetramethylenephosphonic acid, one of its water soluble salts, or mixtures thereof.

12. A method according to claim 10, wherein component (B) consists of 1-hydroxyethylidene-1,1-diphosphonic acid, one of its water soluble salts, or mixtures thereof.

13. A method according to claim 10, wherein component (B) consists of aminotrimethylenephosphonic acid, one of its water soluble salts, or mixtures thereof.

14. A method according to claim 1, wherein the concentration of component (B) is in the range from 2.0 to 7.0 g/L.

15. A method according to claim 14, wherein the concentration of component (D ) is in the range from 0.5 –2.5 g/L.

16. A method according to claim 15, wherein the aqueous alkaline cleaning composition is contacted with the aluminum surface to be cleaned at a temperature in the range from 50°–70° C. by spray or immersion for a time of from 20 to 60 seconds.

17. A method according to claim 16, wherein component (B) consists of ethylenediaminetetramethylenephosphonic acid, one of its water soluble salts, or mixtures thereof.

18. A method according to claim 16, wherein component (B) consists of 1-hydroxyethylidene-1,1-diphosphonic acid, one of its water soluble salts, or mixtures thereof.

19. A method according to claim 16, wherein component (B) consists of aminotrimethylenephosphonic acid, one of its water soluble salts, or mixtures thereof.

20. A method according to claim 1, wherein the concentration of component (D) is in the range from 0.5–2.5 g/L.

* * * * *